US006530741B1

(12) United States Patent
Kourogi et al.

(10) Patent No.: US 6,530,741 B1
(45) Date of Patent: Mar. 11, 2003

(54) SELF PROPELLED VEHICLE WITH A LOADER

(75) Inventors: Isao Kourogi, Hannan (JP); Masami Hirooka, Sakai (JP); Koichi Kawaguchi, Sakai (JP)

(73) Assignee: Kubota Corporation (JP)

( * ) Notice: Subject to any disclaimer, the term of this patent is extended or adjusted under 35 U.S.C. 154(b) by 0 days.

(21) Appl. No.: 09/653,977

(22) Filed: Sep. 1, 2000

(30) Foreign Application Priority Data

Nov. 15, 1999 (JP) ..... 11-324627

(51) Int. Cl.[7] ..... E02F 9/00
(52) U.S. Cl. ..... 414/686; 172/274
(58) Field of Search ..... 414/686; 172/274, 172/275

(56) References Cited

U.S. PATENT DOCUMENTS 6,142,724 A 11/2000 Hirooka et al. ..... 414/686

FOREIGN PATENT DOCUMENTS

JP 11269905 10/1999

JP 11269907 10/1999

*Primary Examiner*—Donald W. Underwood
(74) *Attorney, Agent, or Firm*—Webb Ziesenhiem Logsdon Orkin & Hanson, P.C.

(57) ABSTRACT

A self-propelled vehicle with a loader comprises a vehicle body extending in a fore and aft direction of the vehicle; support bases extending laterally outwardly from opposite sides of the vehicle body; main frames erected on the support bases, respectively, each main frame being in form of a box opening forward and upward and including right and left side walls and a rear wall, the box containing an engageable element; side frames each mounted in the box, each side frame having an engaging element disposed in a lower region thereof for rotatably fitting from above on the engageable element; booms pivotably connected to upper end regions of the side frames, respectively; boom cylinders for swinging the booms relative to the side frames, respectively; and reinforcing members each disposed between the right and left side walls of one of the main frames. Each reinforcing member has a front reinforcing portion extending upward from one of the support bases, a rear reinforcing portion disposed rearwardly of a lower portion of one of the side frames and extending above the engageable element, and an intermediate reinforcing portion interconnecting an upper end of the front reinforcing portions and a lower end of the rear reinforcing portion.

6 Claims, 14 Drawing Sheets

SELF PROPELLED VEHICLE WITH A LOADER

BACKGROUND OF THE INVENTION

1. Field of the Invention

This invention relates to a self-propelled vehicle with a loader, and more particularly to a vehicle such as a tractor with a working implement such as a front loader attached thereto.

2. Description of the Related Art

Conventionally, as an example of self-propelled vehicle with a loader, a tractor has a front loader attached the front thereof. This front loader tractor has support bases laterally outwardly of the front of a tractor body, and main frames erected on the support bases. Each main frame has right and left side walls and a rear wall, and opens forward and upward. A side frame is inserted and attached between the right and left side walls of each main frame. When attaching the side frame, an engaging element disposed in a lower position of the side frame is fitted, while turning downward about a transverse axis, on an engageable element disposed in the main frame, and thereafter a connecting pin is removably extended through the main frame and side frame above the engaging and engageable elements. The side frame has a proximal end of a boom pivotally attached to an upper position thereof, the boom having a bucket at a distal end thereof. A boom cylinder extends between the boom and side frame for swinging the boom.

Such a vehicle with a loader, generally, includes braces disposed laterally of the front of the tractor. Each brace extends forward and downward from the main frame (or side frame), and has a forward end connected to the tractor body. This construction is intended to distribute a load applied from the boom to the side frame and main frame. Such a loader is called a braced loader.

However, where the braced loader is used, the braces disposed laterally of a hood of the tractor are obstructive to a maintenance operation for the interior of the hood, for example. The braces are obstructive also to the driver's forward view. Further, the braces are undesirable from the point of view of outward appearance. Thus, it is desired to attach a braceless loader to the tractor. However, when a load is applied from the boom to the side frame and main frame, in the absence of braces, stress concentrates on a lower portion of the main frame or the lower end thereof fixed to the support base. This gives rise to a problem of strength.

SUMMARY OF THE INVENTION

This invention has been made having regard to the state of the art noted above, and its object is to provide a technique for solving the problem of strength with a self-propelled vehicle with a braceless loader attached thereto.

The above object is fulfiled, according to this invention by a self-propelled vehicle with a loader, comprising a vehicle body extending in a fore and aft direction of the vehicle; support bases extending laterally outwardly from opposite sides of the vehicle body; main frames erected on the support bases, respectively, each of the main frames being in form of a box opening forward and upward and including right and left side walls and a rear wall, the box containing an engageable element;

side frames each mounted in the box, each of the side frames having an engaging element disposed in a lower region thereof for rotatably fitting from above on the engageable element; booms pivotably connected to upper end regions of the side frames, respectively; boom cylinders for swinging the booms relative to the side frames, respectively; and reinforcing members each disposed between the right and left side walls of one of the main frames, each of the reinforcing members having a front reinforcing portion extending upward from one of the support bases, a rear reinforcing portion disposed rearwardly of a lower portion of one of the side frames and extending above the engageable element, and an intermediate reinforcing portion interconnecting an upper end of the front reinforcing portions and a lower end of the rear reinforcing portion.

With the reinforcing members having the above construction, the main frames can reliably receive and bear a load transmitted from the side frames, which load is applied to the engageable elements in time of loader operation. Thus, the main frames can sufficiently withstand the load occurring in time of loader operation, with a high degree of reliability, though braces are dispensed with.

In order to distribute the load applied to the main frames efficiently to the side frames, this invention provides reinforcing units each extending from a region the engageable element of one of the main frames to one of the subframes. In order to secure sufficient strength against a torsional force occurring between the main frames and subframes, each reinforcing unit in a preferred embodiment of this invention defines a box-like section with one of the support bases.

Other features and advantages of this invention will be apparent from the following description of the embodiment to be taken with reference to the drawings.

DESCRIPTION OF THE PREFERRED EMBODIMENT

An embodiment of this invention will be described hereinafter with reference to the drawings.

Figure 1:
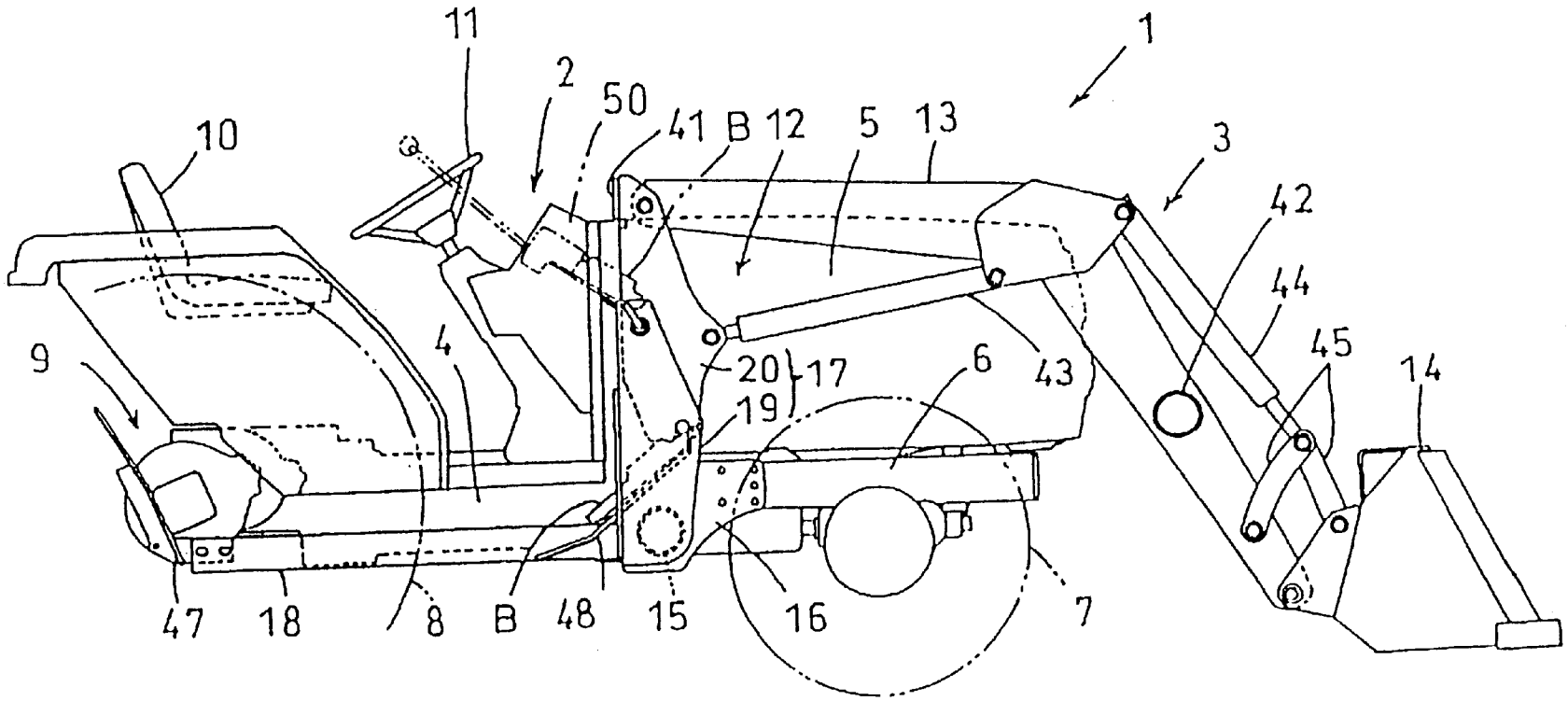
FIG. 1 is a right side view of a self-propelled vehicle with a front loader.

FIG. 1 shows a working vehicle 1 with a loader, i.e. a tractor (self-propelled vehicle) 2 having a front loader 3 attached to the front thereof The tractor 2 has a vehicle body extending fore and aft (traveling direction or longitudinal direction). The vehicle body is formed of a rigid interconnection of components including a clutch housing disposed rearwardly of an engine, and a transmission case disposed rearwardly of the clutch housing. The vehicle body is supported above the ground by a pair of right and left front wheels 7 acting as dirigible wheels, and a pair of right and left rear wheels 8 acting as drive wheels.

The engine is mounted in a hood 5 disposed in a front position. Front axle frames 6 are fixed such as by bolts to lower positions on opposite lateral walls of the engine to projects forwardly of the engine. The front axle frames 6 support the front wheels 7 through front axles and front axle cases.

Rear axle cases 9 are fixed to opposite lateral positions of a rear portion of vehicle body 4 (rear portion of the transmission case) to project right and left therefrom and support the rear wheels 8 through rear axles.

A driver's seat 10 is disposed in an upper rearward position on the vehicle body 4. A steering wheel 11 is disposed forwardly of the driver's seat 10.

The front loader 3 includes, as main components thereof, a post structure 12, booms 13 and a bucket 14.

As shown in FIGS. 1 through 10, the post structure 12 includes, provided in right and left pairs at the front of vehicle body 4, support bases 15 projecting laterally outwardly of the vehicle body 4, mounting brackets 16 for fixedly attaching the support bases 15 to the vehicle body 4, boom supports 17 extending upward from the support bases 15, and subframes 18 arranged laterally of the vehicle body 4 and extending in the fore and aft direction, with forward ends fixed to the support bases 15 and rearward ends fixed to rearward positions of vehicle body 4.

In this embodiment, each support base 15 is formed of a cylindrical pipe with an axis extending transversely of the tractor body 4. The support base 15 has a transversely inward end thereof fixed as by welding to the mounting bracket 16. The mounting bracket 16 is formed of a plate material and fixed to the vehicle body 4.

Specifically, each mounting bracket 16 is fixed in forward positions thereof to a side surface of one of the front axle frames 6 such as by bolts, is bolted in upper and intermediate positions at the rear end directly to the vehicle body 4. The right and left mounting brackets 16 are interconnected in lower rear positions thereof by a connecting frame not shown. The connecting frame is fixed to a lower surface of the vehicle body 4.

Each boom support 17 includes, as main components thereof, a main frame 19 fixed to a transversely outward end side of support base 15, and a side frame 20 detachably attached to the main frame 19.

The main frame 19 is channel-shaped in plan view, having right and left side walls 19*a* and a rear wall 19*b* and opening forward and upward. The main frame 19 has a support shaft 21 (engageable element) fixed to a front portion in a vertical intermediate position thereof and extending through the right and left side walls 19*a*. The main frame 19 has also receiving bores 22 formed in upper positions of the right and left side walls 19*a*.

The main frame 19 is fixed as by welding in lower positions thereof to an outward portion of the support base 15 extending through the right and left side walls 19*a*. Thus, the main frame 19 is supported by and extend upward from the support base 15.

The side frame 20 is channel-shaped in plan view, having right and left side walls 20*a* and a rear wall 20*b* and opening forward and upward. The side frame 20 includes an engaging member 28 formed of a bent plate and disposed in a lower front position thereof and extending between the right and left side walls 20*a*. The engaging member 28 defines an arcuate recess 29 (engaging element) extending transversely and opening downward. The recess 29 acting as the engaging element is fitted from above on the support shaft 21 acting as the engageable element of the main frame 9 to be rotatable about a transverse axis.

Figure 2:
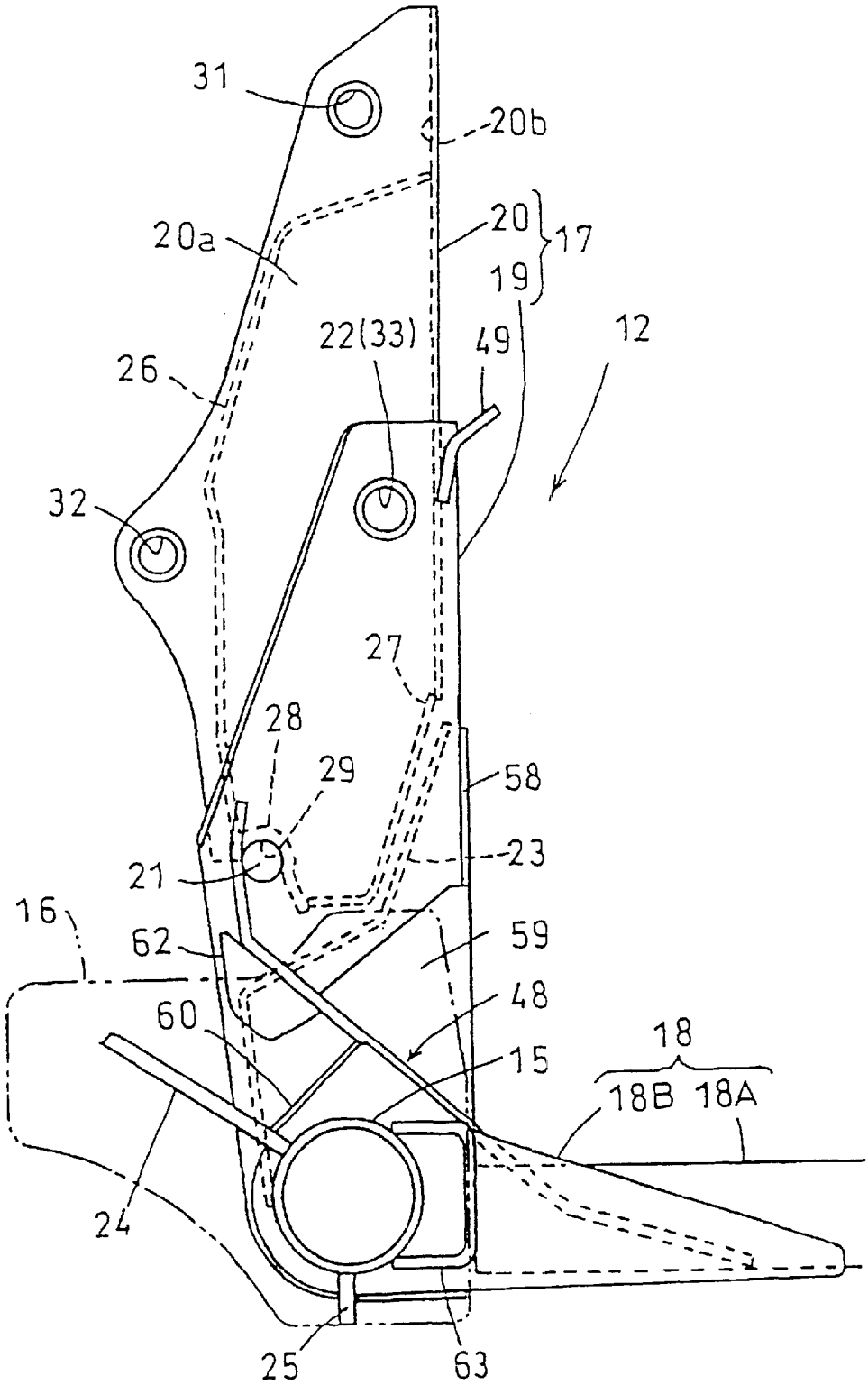
FIG. 2 is a left side view of a right boom support.
Figure 3:
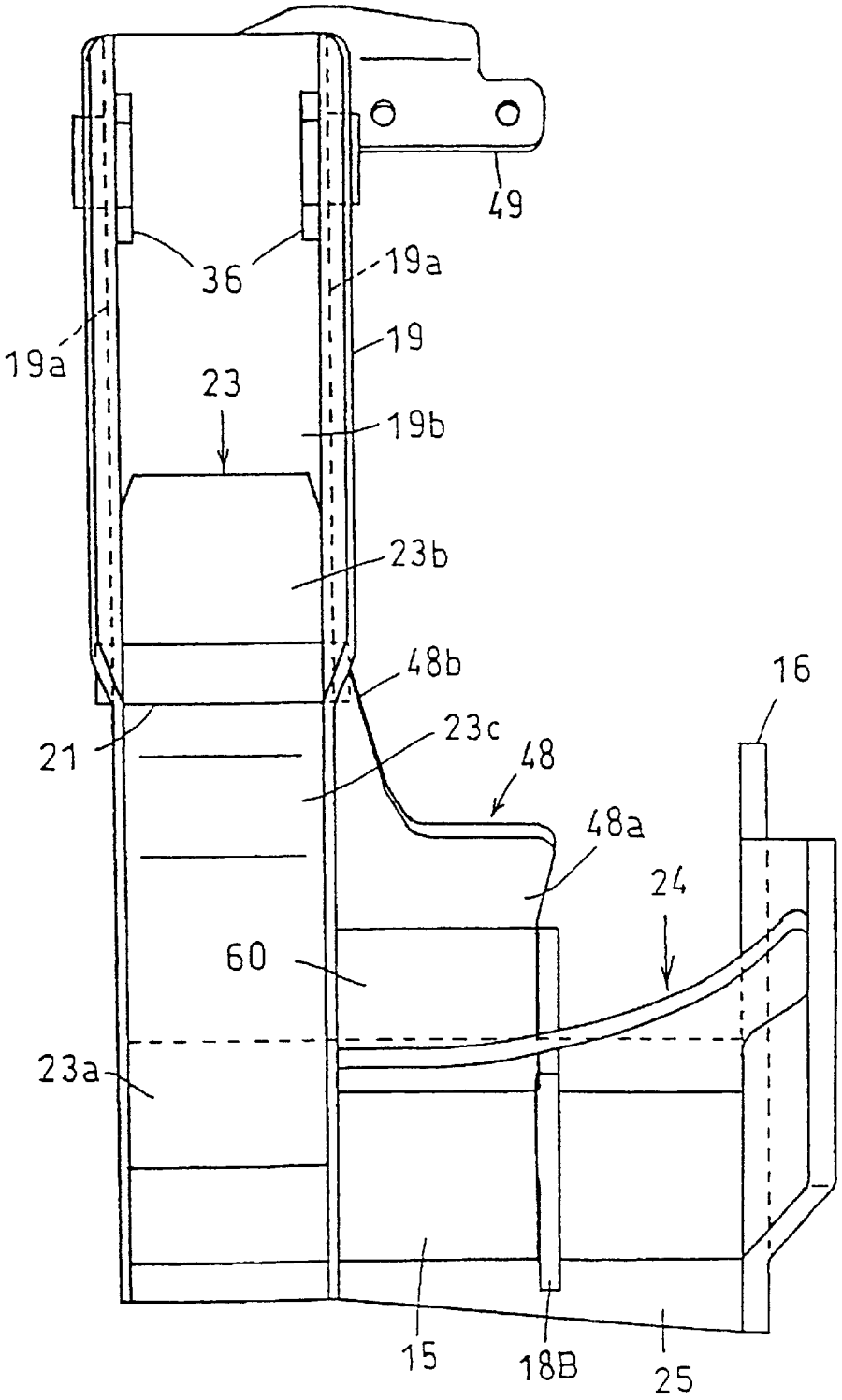
FIG. 3 is a front view of a right main frame and support.

Between right and left side walls 20*a* are reinforcing members 26 and 27 formed of plate or the like and interconnecting the right and left side walls 20*a*. The reinforcing member 26 extends upward from a front position of engaging member 28, and is curved in an upper position to extend rearward to the rear wall 20*b*. The reinforcing member 27 extends rearward from the rear end of engaging member 28, and is bent to extend rearward and upward to the lower end of rear wall 20*b* (FIG. 2). The right and left side frames 20 are interconnected in upper positions thereof by a connector (crossbar) 41 shown in FIG. 1.

Figure 12:
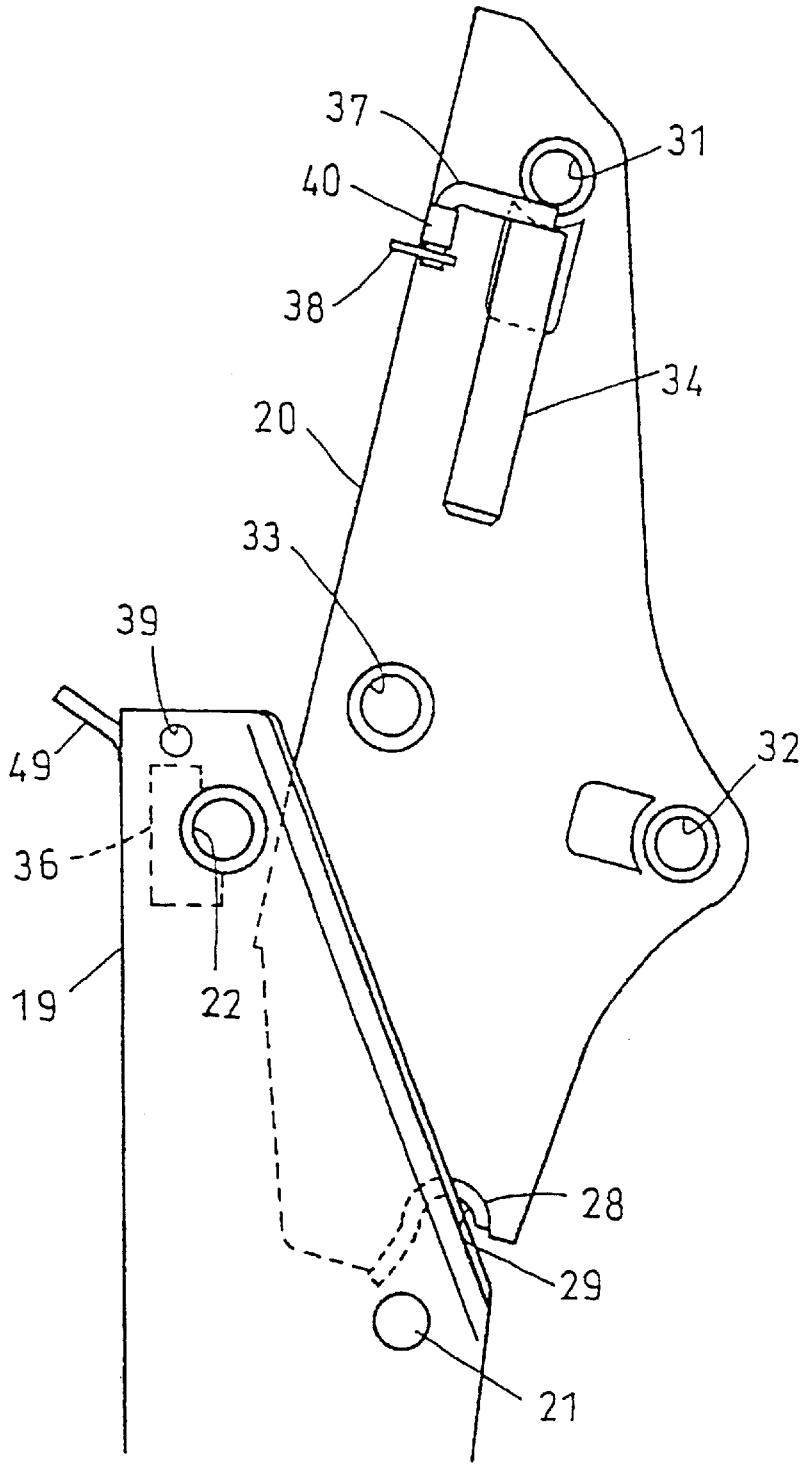
FIG. 12 is a side view of the right side frame in a detached state.

As shown in FIG. 12, each side frame 20 has receiving bores 31, 32 and 33 formed in upper positions and front and rear, vertically intermediate positions of the right and left side walls 20*a*.

Figure 11:
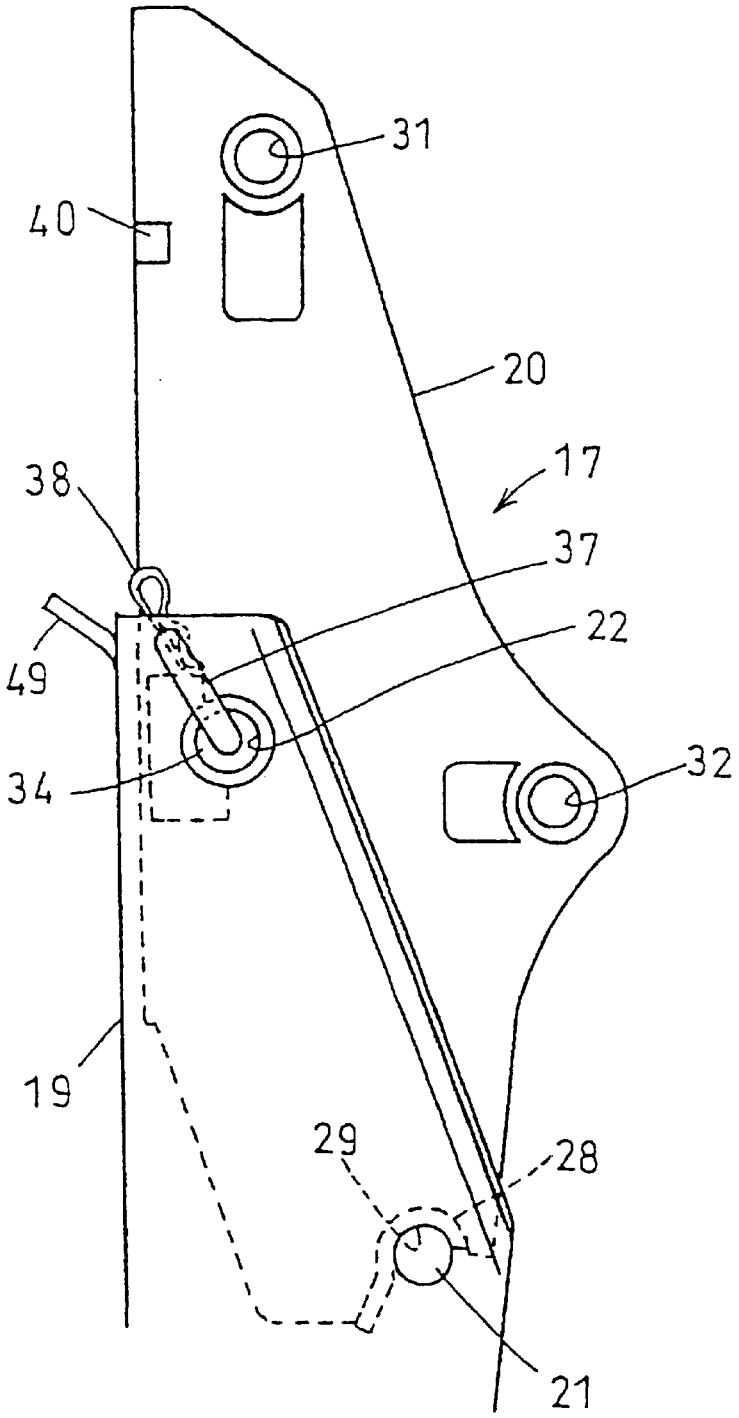
FIG. 11 is a right side view of the right side frame attached to the main frame.
Figure 13:
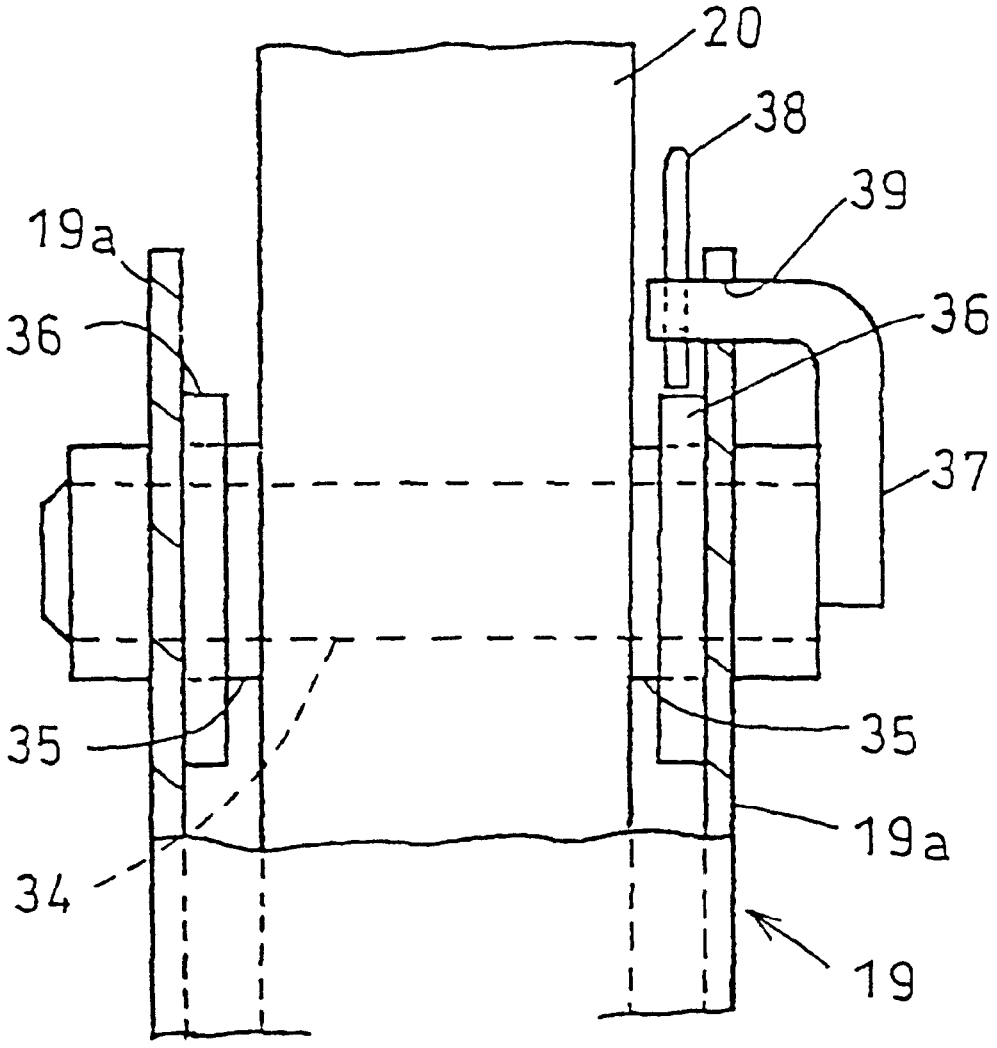
FIG. 13 is a rear view, partly in section, of a pin connected portion of the boom support.

As shown in FIGS. 2, 11 and 13, with the recess 29 of side frame 20 fitted from above on the support shaft 21 of main frame 19, the receiving bores 33 formed in the rear, vertically intermediate position of side frame 20 are aligned to the receiving bores 22 of main frame 19. The side frame 20 is fixed to the main frame 19 by inserting a connecting pin 34 through these receiving bores 22 and 33.

The right and left side walls 19*a* of each main frame 19 have boss guides 36 formed in upper positions on inner surfaces thereof for fitting on bosses 35 formed on outer surfaces of side frame 20, around the receiving bores 33.

The connecting pin 34 has an L-shaped engaging member 37 fixed to a transversely outward end thereof The engaging member 37 is bent transversely inwardly into an L shape. On the other hand, the transversely outward side wall 19*a* of main frame 19 defines a receiving bore 39 for receiving the bent portion of engaging member 37. The engaging member 37 is retained in place by a retainer 38 such as a beta pin engaging the engaging member 37 inwardly of the transversely outward side wall 19*a* of main frame 19.

The connecting pin 34 is withdrawn from the receiving bores 22 and 33 when separating the side frame 20 from the main frame 19. The side frame 20 has a cylindrical pin holder 40 attached to an upper rear position on an outer surface of the transversely outward side wall 20*a*. After the connecting pin 34 is withdrawn from the receiving bores 22 and 33, the bent portion of engaging member 37 is placed in the pin holder 40, and the retainer 38 is engaged with the engaging member 37 to retain the engaging member 37 in the pin holder 40.

Loss of the connecting pin 34 is avoided by placing the connecting pin 34, when unused, in the pin holder 40 as noted above.

The pin holder 40 and the like are disposed within reach of the driver on the tractor 2. Thus, while riding the tractor 2, the driver may move the connecting pin 34 into and out of the receiving bores 22 and 33, and placing the connecting pin 34 in the pin holder 40.

The right and left pair of booms 13 are connected at proximal ends (rear ends) thereof to the side frames 20 through pins extending through the receiving bores 31 of side frames 20, to be pivotable about a transverse axis. The bucket 14 is attached to the distal ends of booms 13 to be pivotable about a transverse axis.

The right and left booms 13 are interconnected in forward positions thereof through a connecting pipe 42.

The receiving bores 32 of side frames 20 are used as couplings for connecting hydraulic cylinders (boom cylinders). The couplings are connected to intermediate regions of the booms 13 by boom cylinders 43. The booms 13 are swung up and down by extension and contraction of boom cylinders 43.

Each boom 13 has a bucket cylinder 44 comprising a hydraulic cylinder disposed in an upper forward region thereof. The bucket cylinder 44 is pivotally connected at a proximal end thereof to an intermediate position of the boom 13. A pair of links 45 are provided at the distal end of bucket cylinder 44. One of the links 45 is pivotally connected to the bucket 14, while the other link 45 is pivotally connected to the boom 13. The bucket 14 is driven by extension and contraction of bucket cylinders 44 to perform scooping and dumping operations.

Figure 8:
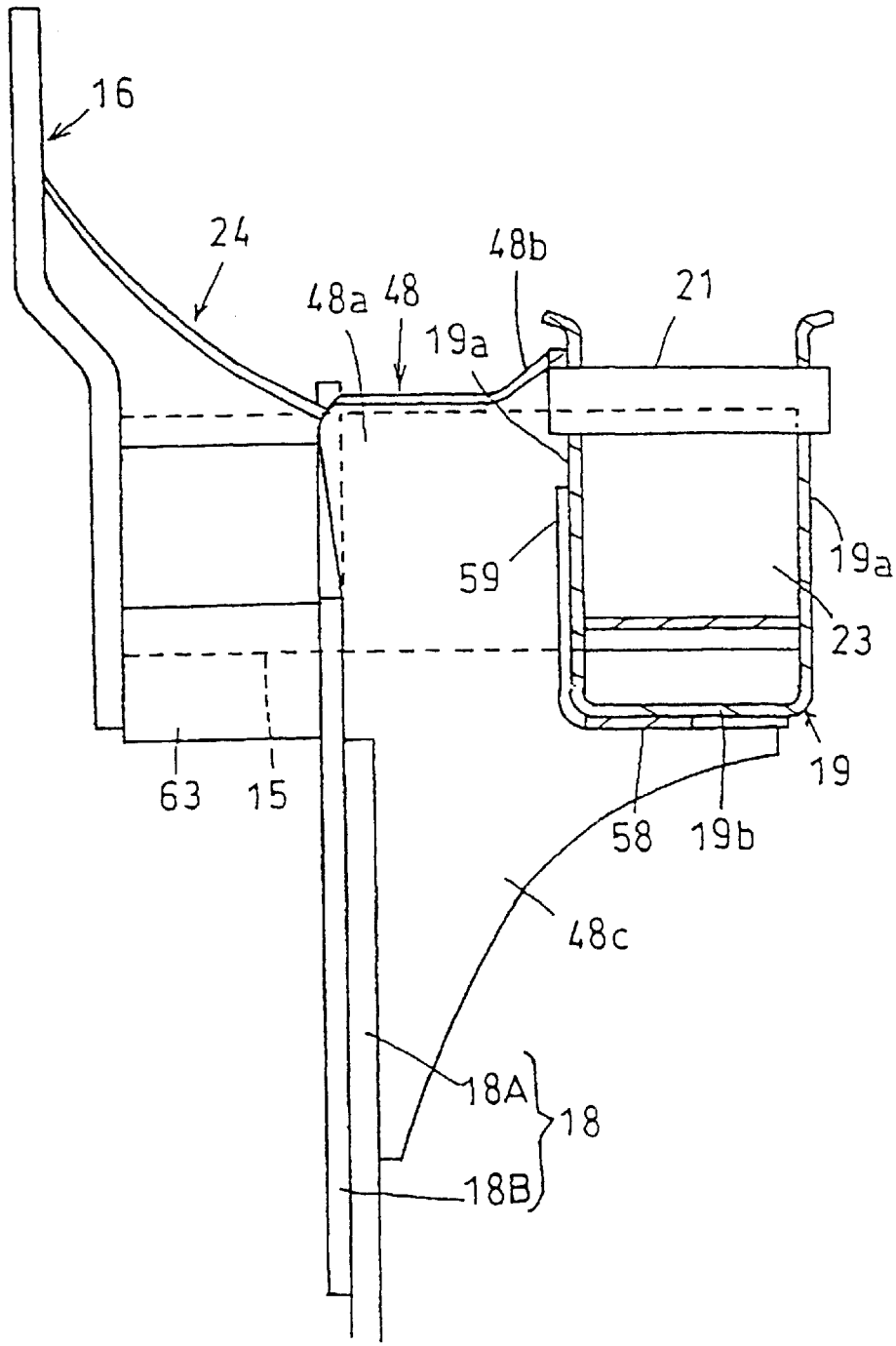
FIG. 8 is a plan view, partly in section, of the right main frame.

Each subframe 18 includes a main plate 18A formed of an elongate plate material, and a bracket 18B connected to the support base 15 (FIGS. 2 and 8). The bracket 18B is disposed between the main frame 19 and mounting bracket 16, and fitted on and fixed as by welding to the support base 15.

The main plate 18A is disposed in a lower lateral region of the vehicle body to extend in the fore and aft direction from front to rear. The front of main plate 18A is fixed as by welding to a portion of the bracket 18B projecting rearward from the support base 15. The rear end of main plate 18A is fixed to the vehicle body 4 by being fixed as by bolts to a bracket 47 fixed to the rear axle case 9 or the like (FIG. 1).

The main plate 18A and bracket 18B may be formed integral with each other. The rear end of each subframe 18 may be fixed directly to the vehicle body 4, or may be fixed to a different component fixed to the vehicle body 4. Where the tractor 2 is the type having a backhoe attachable to the rear thereof, the rear end of subframe 18 may be fixed to a backhoe mounting frame fixed to the rear axle case 9.

Figure 5:
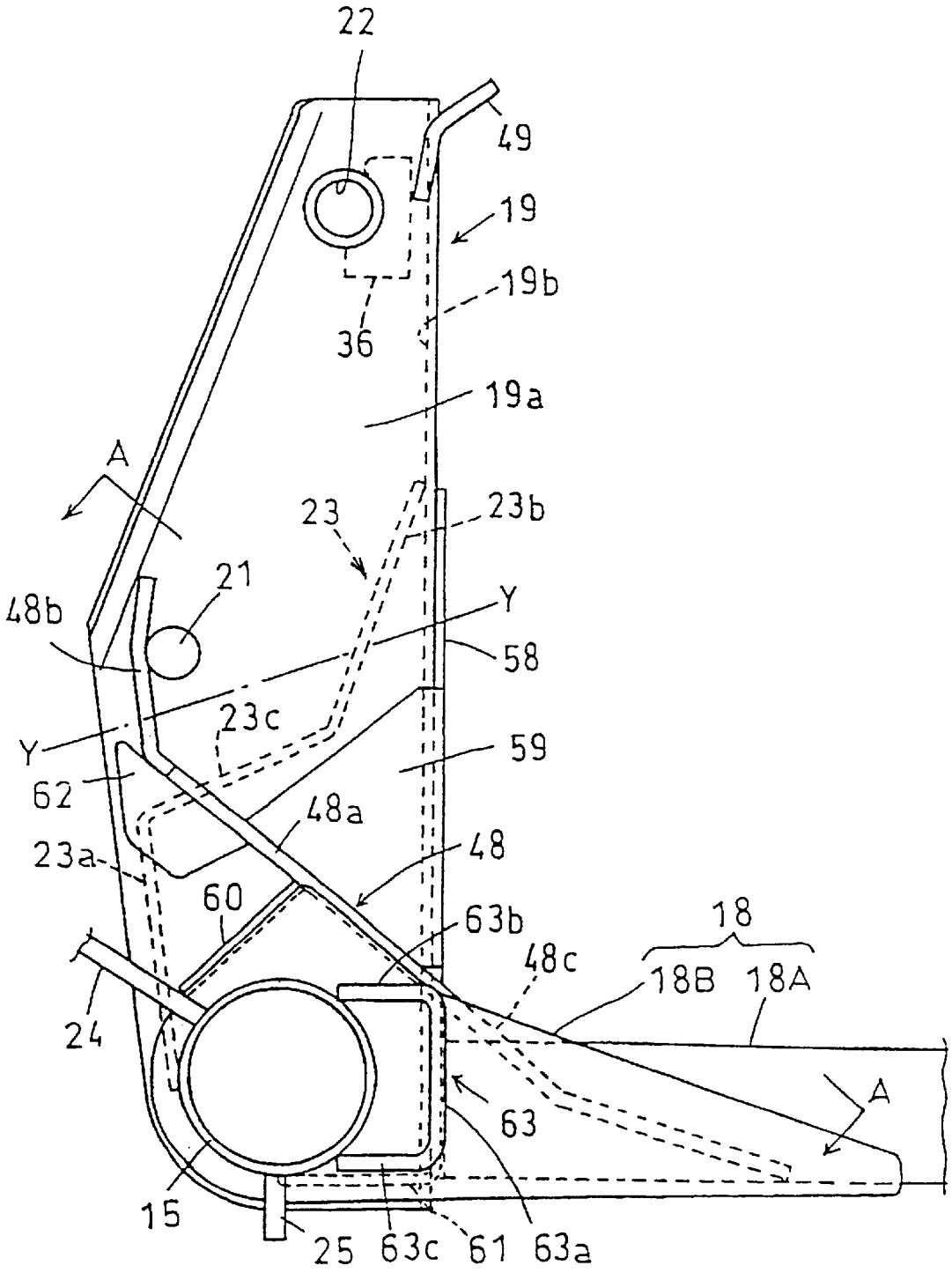
FIG. 5 is a left side view of the right main frame and support.

Each main frame 19 includes a reinforcing member 23 formed of a plate material or the like disposed in a lower region between and interconnecting the right and left side walls 19*a* (FIG. 5). This reinforcing member 23 has a front reinforcing portion 23*a* extending upward from the support base 15, with a lower end thereof fixed as by welding to a vertically intermediate position (middle position) on a front surface of the support base 15, a rear reinforcing portion 23*b* disposed in a lower rear region of the side frame 20 and extending above the support shaft 21, and an intermediate reinforcing portion 23*c* disposed in a lower front region of the side frame 20 and interconnecting the front reinforcing portion 23*a* and rear reinforcing portion 23*b*.

The rear reinforcing portion 23*b* is inclined to extend upwardly and rearwardly so as to follow a lower rear profile of the side frame 20 attached (the rear profile of reinforcing member 27). The upper end of rear reinforcing portion 23*b* is located in a vertically intermediate position between the support shaft 21 and receiving bore 22 and on the rear wall 19*b* of main frame 19, and fixed as by welding to the wall 19*b*.

If the rear reinforcing portion 23*b* of reinforcing member 23 had the same angle of inclination as the intermediate reinforcing portion 23*c*, in the absence of a brace, a heavy load would be applied from the boom 13 to the main frame 19 at line Y—Y in FIG. 5. With the rear reinforcing portion 23*b* disposed as illustrated, the load may be withstood sufficient. In the braceless front loader 3, a deformation at line Y—Y of the main frame 19 is avoided.

To avoid a deformation at line Y—Y of the main frame 19 even under a greater load, reinforcing members 58 and 59 formed of a plate material or the like are applied and fixed as by welding to a lower outer surface of the rear wall 19*b* and a lower outer surface of the inward side wall 19*a* of main frame 19. The lower regions of main frame 19 are reinforced also by application of the reinforcing members 58 and 59. Thus, in the braceless front loader, sufficient strength is secured for the main frame 19.

The reinforcing member 58 extends from adjacent the upper end (or from the upper end) of the reinforcing member 23 to adjacent the lower end (or to the lower end) of the main frame 19. The reinforcing member 58 has an upper portion thereof progressively increasing in width as it extends downward. The reinforcing member 59 is integral with and extends forward from a vertically intermediate portion on a transversely inward edge of the reinforcing member 58.

Figure 4:
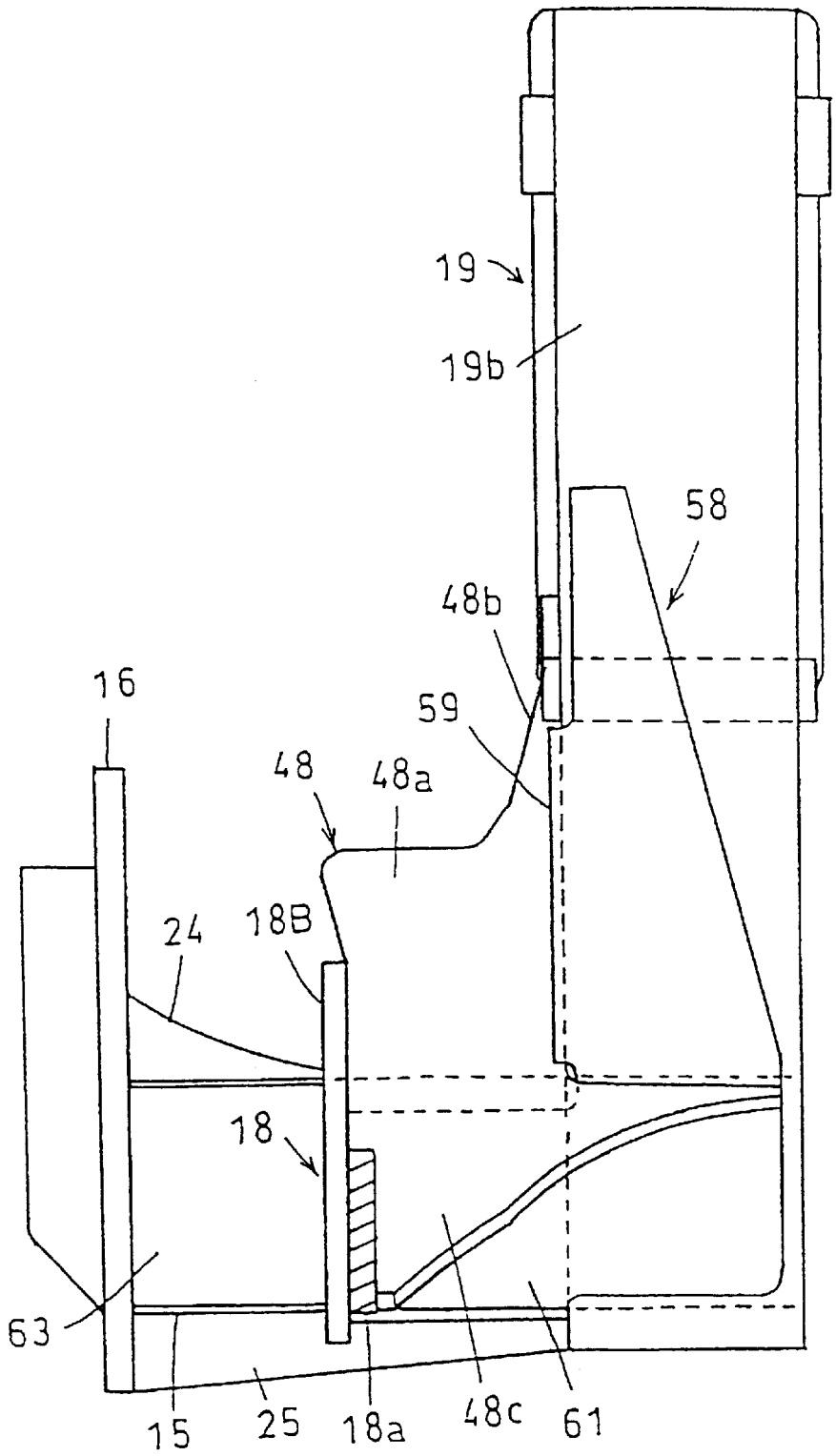
FIG. 4 is a rear view of the right main frame and support.

Reinforcing members 24 and 25 formed of a plate material or the like are disposed in forward and downward regions between each main frame 19 and mounting bracket 16 (FIG. 4)

The reinforcing member 24 extends upwardly and forwardly from an upper front position of the support base 15, and increases in width from the main frame 19 toward the mounting bracket 16. The reinforcing member 24 is fixed as by welding to the support base 15, mounting bracket 16 and main frame 19. The reinforcing member 25 extends downward from a middle position in the fore and aft direction on a lower surface of the support base 15, and increases in width from the main frame 19 toward the mounting bracket 16. The reinforcing member 25 is fixed as by welding to the support base 15, mounting bracket 16 and main frame 19.

Figure 6:
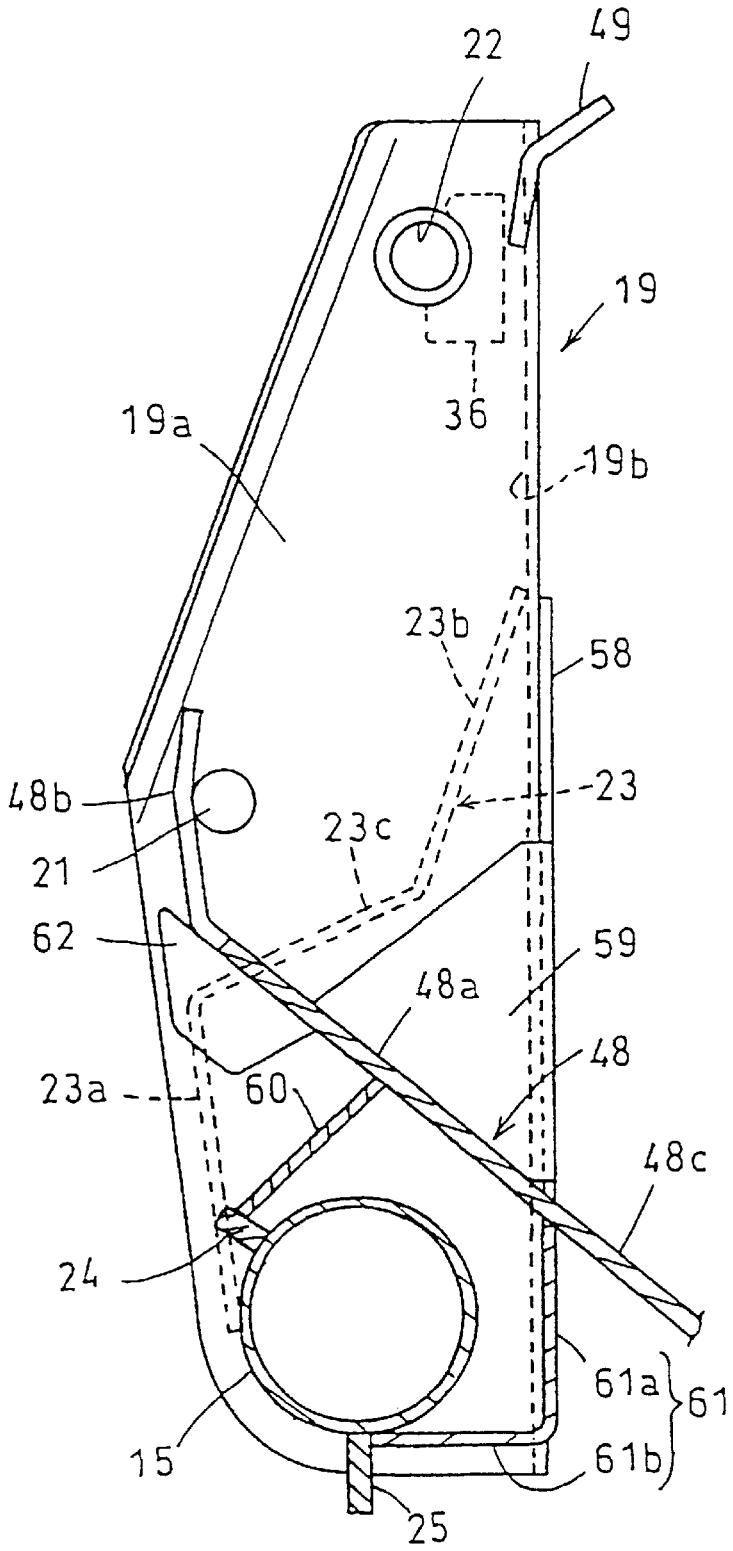
FIG. 6 is a left side view of the right main frame and support.
Figure 7:
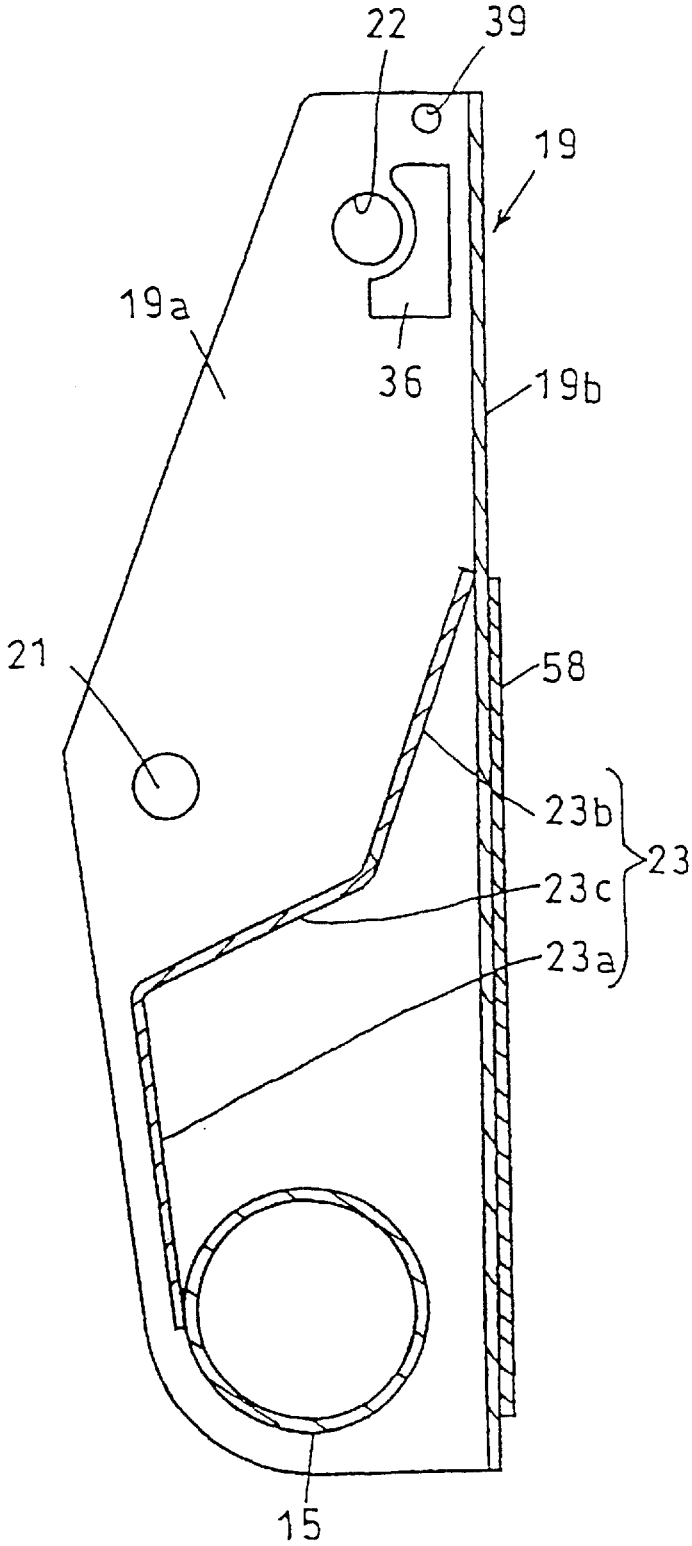
FIG. 7 is a sectional side view of the main frame.

As shown in FIG. 6, reinforcing plates 48, 60 and 61 are disposed between the main frame 19 and subframe 18 to define a reinforcing unit of box-like structure in combination with the support base 15.

The reinforcing plate 48 extends from the support shaft 21 disposed above the front of support base 15 to a rearward position of the bracket 18B disposed rearwardly of the support base 15. The reinforcing plate 48 has an intermediate portion 48*a* extending rearwardly and downwardly from a position under the support shaft 21 toward the rear end of main frame 19. The intermediate portion 48*a* is fixed as by welding to an outer surface of the transversely inward side wall 19*a* of main frame 19 and to an outer surface of subframe 18 (bracket 18B).

A lower edge of reinforcing member 59 noted hereinbefore is fixed as by welding to the intermediate portion 48*a*. A reinforcing member 62 is disposed on a lower forward surface of the intermediate portion 48*a*. The reinforcing member 62 is fixed as by welding to the outer surface of the transversely inward side wall 19*a* of main frame 19 and to the lower surface of the intermediate portion 48*a*.

A front portion 48*b* of reinforcing plate 48 has a smaller width than the intermediate portion 48*a*, and extends upward from a transversely outward position at the forward end of the intermediate portion 48*a*, past the front of support shaft 21 to a position above the support shaft 21. The front portion 48*b* is fixed as by welding to the outer surface of the transversely inward side wall 19*a* of main frame 19 and to the support shaft 21.

A rear portion 48*c* of reinforcing plate 48 extends rearwardly and downwardly from the intermediate portion 48*a* and the reinforcing member 58, and decreases in width as it extends rearward. The rear portion 48*c* is bent to incline by a less degree, and is fixed as by welding to the reinforcing member 58 and subframe 18 (main plate 18A) (FIG. 8).

The reinforcing plate 60 extends forwardly and downwardly from the intermediate portion 48*a* of reinforcing plate 48 to the reinforcing member 24 (in a region above the support base 15). The reinforcing plate 60 is fixed as by welding to the main frame 19, intermediate portion 48*a* of reinforcing plate 48, reinforcing member 24 and subframe 18 (bracket 18B), and interconnects the intermediate portion 48*a* of reinforcing plate 48 and the reinforcing member 24.

The reinforcing plate 61 includes a vertical wall 61*a* disposed rearwardly of the support base 15, and a lower wall 61*b* extending forward from the lower end of vertical wall 61*a*. The vertical wall 61*a* is integral with and extends transversely inward from the lower end of reinforcing member 58, and is fixed as by welding to the lower surface of reinforcing plate 48 and to the subframe 18 (bracket 18B). The lower wall 61*b* has a projecting end thereof fixed as by welding to the middle position in the fore and aft direction on the lower surface of support base 15. The lower wall 61*b* is fixed as by welding to the main frame 19 and subframe 18 (bracket 18B).

Thus, the box-like structure is defined by the intermediate portion 48*a* of reinforcing plate 48, reinforcing plates 60 and 61, the portion of reinforcing member 24 between the main frame 19 and subframe 18 (bracket 18B), and the portion of support base 15 between the reinforcing member 24 and reinforcing plate 61 (forward end of lower wall 61*b*).

The braceless front loader 3 cannot secure sufficient torsional strength even where a large-diameter tube is used as each support base 21. However, the box-like structure noted above can secure sufficient torsional strength between the main frame 19 and subframe 18, without increasing the diameter of support base 21. In this way, strength is secured for the post structure 12 of the braceless front loader 3.

A reinforcing channel member 63 formed of a plate material or the like is disposed between the bracket 18B of subframe 18 and the mounting bracket 16 and rearwardly of the support base 21. The reinforcing channel member 63 extends from the bracket 18B to the mounting bracket 16, and is fixed as by welding to these brackets 18B and 16.

This reinforcing channel member 63 is U-shaped in side view, opening forward, and includes a rear wall portion 63*a*, an upper wall portion 63*b* extending forward from an upper end of rear wall portion 63*a*, and a lower wall portion 63*c* extending forward from a lower end of rear wall portion 63*a*. The upper wall portion 63*b* and lower wall portion 63*c* have forward ends (i.e. projecting ends) thereof fixed as by welding to rearward positions of the support base 21, respectively.

In the above construction, the front portion 48*b* of reinforcing plate 48 increases (or secures) strength for the position where the support shaft 21 is fixed, and the rear portion 48*c* of reinforcing plate 48 is fixed to the front of the main plate 18A of subframe 18 (that is, the support shaft 21 and subframe 18 are interconnected through the reinforcing plate 48). Thus, in time of operation, the load applied from the boom 13 to the main frame 19 is distributed to the subframe 18.

As described above, the front loader 3 is constructed in such a way that the absence of braces presents no problem. The absence of braces allows a maintenance operation for the interior of hood 5 to be carried out with ease, allows an improved field of view, and presents an excellent outward appearance.

Figure 9:
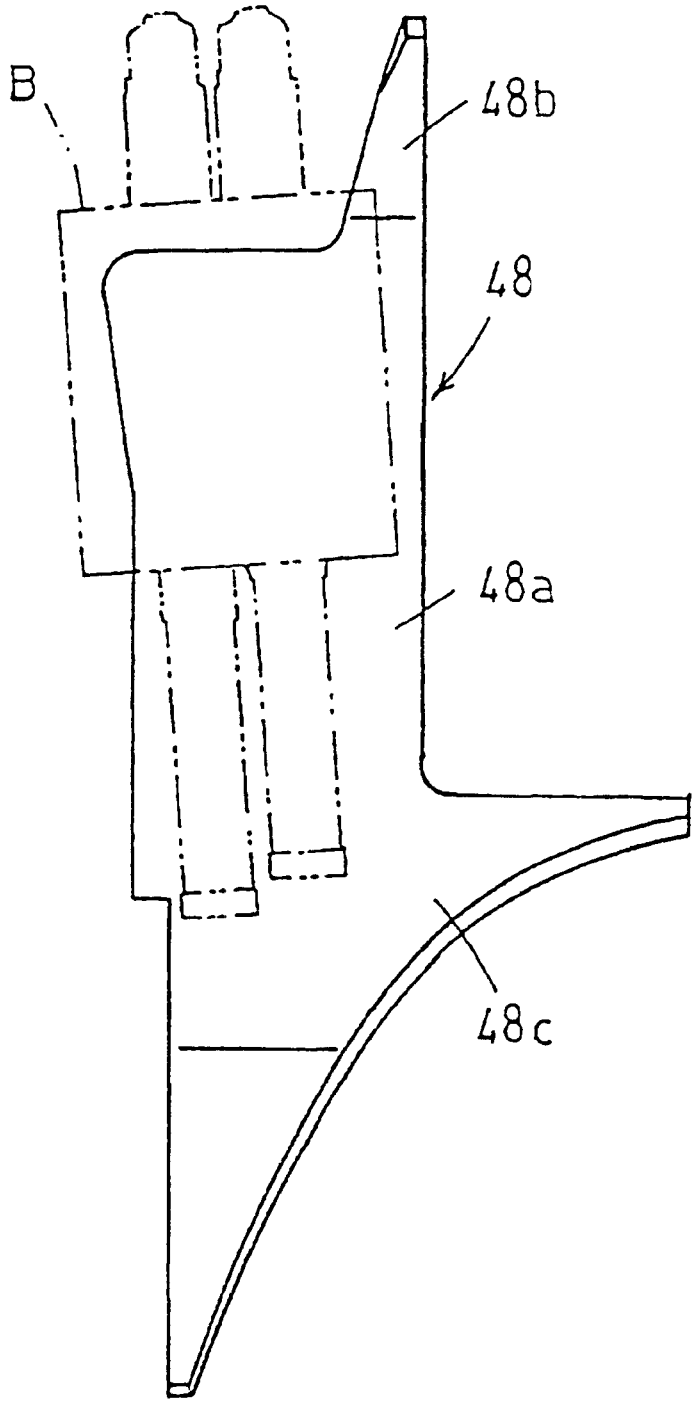
FIG. 9 is a section taken on line A—A of FIG. 5 and showing a reinforcing unit.
Figure 10:
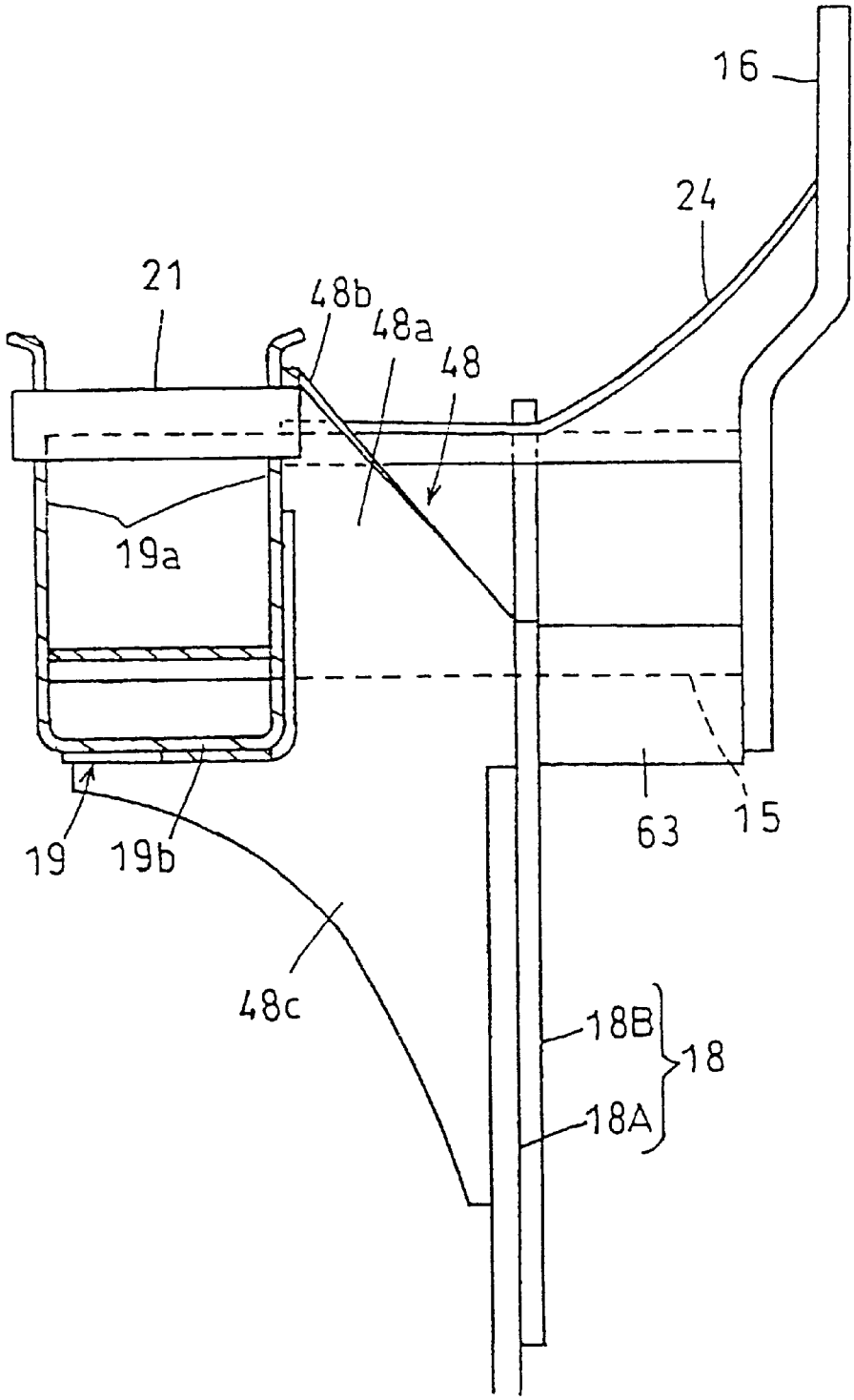
FIG. 10 is a plan view, partly in section, of a left main frame.
Figure 14:
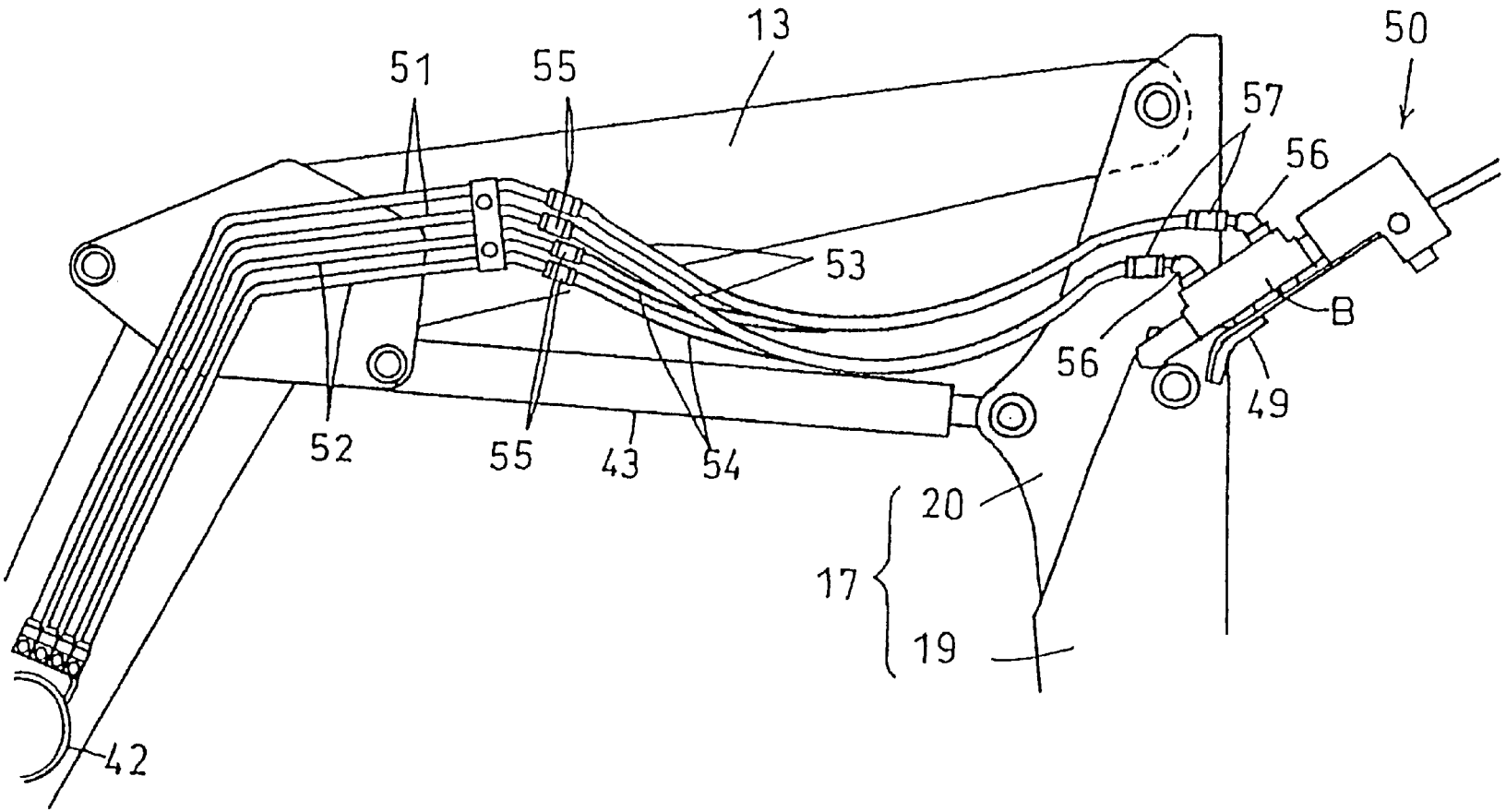
FIG. 14 is a side view showing a piping structure of the front loader.

As shown in FIG. 9, the intermediate portion 48*a* of one of the right and left reinforcing plates 48 (the right one in this embodiment) has an increased width in a forward area thereof. Where a cab (not shown) is provided on the vehicle body 4, this reinforcing plate 48 acts as a valve stay for fixedly holding a control valve B to control the boom cylinders 43 and bucket cylinders 44. Thus, at the right side of post structure 12, the valve stay serves as the reinforcing plate 48. The valve stay has a front portion extending above the front of the engageable element, and a rear portion extend rearwardly of the support base to be fixed to a side surface of the side frame, to secure strength for the position where the engageable element is fixed, and to distribute to the subframe the load applied from the boom to the main frame.

Where a cab is provided on the vehicle body 4, a control device is disposed adjacent the driver's seat in the cab for operating the control valve B. The control device is operatively connected to the control valve B by wires or the like.

Where the vehicle body 4 has no cab, as shown in FIGS. 1 and 14, the control valve B is mounted on a valve stay 49 fixed to a transversely inward position adjacent the upper end of the right main frame 19. A control device 50 including control levers is attached to the valve stay 49. The control device 50 is used to operate the control valve B to control the boom cylinders 43 and bucket cylinders 44.

As shown in FIG. 14, pressure oil supply and drain pipes 51 and 52 are arranged along a transversely inward surface of the right boom 13 and above the connecting pipe 42. The hydraulic pipes 51 communicate with the right and left bucket cylinders 44, while the hydraulic pipes 52 communicate with the right and left boom cylinders 43. The hydraulic pipes 51 and 52 are connected at rear ends thereof to the control valve B through hydraulic hoses 53 and 54, and at the other ends to the bucket cylinders 44 and boom cylinders 43 through hydraulic hoses, respectively.

Rearward portions of hydraulic pipes 51 and 52 are bent to extend rearwardly and downwardly, to which the forward ends of hydraulic hose 53 and 54 are connected through hydraulic couplers 55.

The control valve B is inclined to extend rearwardly and upwardly, and defines oil input and output ports on an upper surface thereof. 45-degree adapters 56 are connected to the ports to deflect oil passages 45 degrees forward. The rear ends of hydraulic hoses 53 and 54 are connected to the adapters 56 through hydraulic couplers 57. Consequently, the hydraulic hoses 53 and 54 are curved upward in a direction to protrude above the boom, not to obstruct the forward view of the operator.

Further, rear end regions of hydraulic pipes 51 and 52 are curved downward. This, in combination with the 45-dgree adapters 56 connected to the ports of the control valve B, causes the hydraulic hoses 53 and 54 to sag in a downward curve, whereby the hydraulic hoses 53 and 54 do not protrude above the boom 13. As a result, even when the boom 13 is swung up and down, the hydraulic hoses 53 and 54 are contained below the upper edge of boom 13 instead of protruding upward. For separating the side frames 20 from the main frames 19, the boom cylinders 43, for example, are operated to raise the side frames 20 away from the main frames 19. For this reason, the hydraulic hoses 53 and 54 are given a sufficient length to sag when the side frames 20 are attached to the main frames 19.

What is claimed is:

1. A self-propelled vehicle with a loader, comprising:

a vehicle body extending in a fore and aft direction of the vehicle;

support bases extending laterally outwardly from opposite sides of said vehicle body;

main frames erected on said support bases, respectively, each of said main frames being in form of a box opening forward and upward and including right and left side walls and a rear wall, said box containing an engageable element;

side frames each mounted in said box, each of said side frames having an engaging element disposed in a lower region thereof for rotatably fitting from above on said engageable element;

booms pivotably connected to upper end regions of said side frames, respectively;

boom cylinders for swinging said booms relative to said side frames, respectively; and reinforcing members each disposed between said right and left side walls of one of said main frames, each of said reinforcing members having a front reinforcing portion extending upward from one of said support bases, a rear reinforcing portion disposed rearwardly of a lower portion of one of said side frames and extending above said engageable element, and an intermediate reinforcing portion interconnecting an upper end of said front reinforcing portions and a lower end of said rear reinforcing portion.

2. A self-propelled vehicle with a loader as defined in claim 1, wherein each of said main frames includes a reinforcing member applied thereto and extending from an outer surface of a lower portion of said rear wall to an outer surface of a lower portion of an inward one of said side walls.

3. A self-propelled vehicle with a loader, comprising:

a vehicle body extending in a fore and aft direction of the vehicle;

support bases extending laterally outwardly from opposite sides of each vehicle body;

main frames erected on said support bases, respectively, each of said main frames having an engageable element;

side frames attached to said main frames, respectively, each of said side frames having an engaging element disposed in a lower region thereof for rotatably fitting from above on said engageable element;

booms pivotably connected to upper end regions of said side flames, respectively; and boom cylinders for swinging said booms relative to said side frames, respectively; and subframes extending in the fore and aft direction of the vehicle and fixed to opposite lateral positions of said vehicle body, respectively; and reinforcing units each extending from a region of said engageable element of one of said main frames to one of said subframes, wherein each of said reinforcing units defines a box-like section with one of said support bases.

4. A self-propelled vehicle with a loader, comprising:

a vehicle body extending in a fore and aft direction of the vehicle;

support bases extending laterally outwardly from opposite sides of each vehicle body;

main frames erected on said support bases, respectively, each of said main frames having an engageable element;

side frames attached to said main frames, respectively, each of said side frames having an engaging element disposed in a lower region thereof for rotatably fitting from above on said engageable element;

booms pivotably connected to upper end regions of said side frames, respectively; and boom cylinders for swinging said booms relative to said side frames, respectively; and subframes extending in the fore and aft direction of the vehicle and fixed to opposite lateral positions of said vehicle body, respectively; and reinforcing units each extending from a region of said engageable element of one of said main frames to one of said subframes, wherein each of said support bases has a pipe structure, each of said reinforcing units having a reinforcing channel member with an open end abutting with and welded to a rear peripheral surface of said pipe structure.

5. A self-propelled vehicle as defined in claim 4, wherein each of said reinforcing units includes a reinforcing plate having one end thereof welded to said engageable element, and the other end welded to one of said subframes.

6. A self-propelled vehicle as defined in claim 3, wherein each of said reinforcing units includes a reinforcing plate having one end thereof welded to said engageable element, and the other end welded to one of said subframes.

* * * * *

UNITED STATES PATENT AND TRADEMARK OFFICE

CERTIFICATE OF CORRECTION

PATENT NO. : 6,530,741 B1
DATED : March 11, 2003
INVENTOR(S) : Isao Kourogi et al.

It is certified that error appears in the above-identified patent and that said Letters Patent is hereby corrected as shown below:

Title page, Item [54] and Column 1, line 1,
"SELF PROPELLED" should read -- SELF-PROPELLED --.

Title page,
Item [56], References Cited, U.S. PATENT DOCUMENTS, insert:
-- 5,620,297 04/1997 Mahaney ..... 414/686 --.

Column 1,
Line 14, "attached the front" should read -- attached to the front --.

Column 2,
Line 67, after "thereof" insert period -- (.) --.

Column 3,
Line 13, "projects" should read -- project --.

Column 4,
Line 39, between "thereof" and "The" insert period -- (.) --.

Column 8,
Line 14, "extend" should read -- extending --.
Line 43, "hose 53 and 54" should read -- hoses 53 and 54 --.

Column 9,
Line 8, "in form of" should read -- in the form of --.

UNITED STATES PATENT AND TRADEMARK OFFICE

CERTIFICATE OF CORRECTION

PATENT NO. : 6,530,741 B1
DATED : March 11, 2003
INVENTOR(S) : Isao Kourogi et al.

It is certified that error appears in the above-identified patent and that said Letters Patent is hereby corrected as shown below:

Column 10,
Line 2, “flames” should read -- frames --.

Signed and Sealed this

Twenty-sixth Day of August, 2003

JAMES E. ROGAN
*Director of the United States Patent and Trademark Office*